United States Patent [19]

Tomlinson

[11] Patent Number: 4,616,994

[45] Date of Patent: Oct. 14, 1986

[54] GAS BURNER WITH MEANS FOR REDUCING $NO_x$ EMISSIONS

[75] Inventor: Ronald S. Tomlinson, Antioch Township, Davidson County, Tenn.

[73] Assignee: Heil-Quaker Corporation, Benton Harbor, Mich.

[21] Appl. No.: 658,204

[22] Filed: Oct. 5, 1984

[51] Int. Cl.[4] ..... F23D 14/12

[52] U.S. Cl. ..... 431/347; 431/350

[58] Field of Search ..... 431/343, 347, 350, 353, 431/286

[56] References Cited

U.S. PATENT DOCUMENTS

| | | | |
|---|---|---|---|
| 2,193,176 | 3/1940 | Krugler et al. | 431/343 |
| 2,905,235 | 9/1959 | Dolby | 431/349 |
| 3,177,923 | 4/1965 | Hine, Jr. et al. | 431/350 |
| 3,259,170 | 7/1966 | Koehrer | 431/350 |
| 3,544,255 | 12/1970 | Roper | 431/350 |
| 3,574,507 | 4/1971 | Kydd | 431/350 |
| 3,649,211 | 3/1972 | Vosper | 431/350 X |
| 4,284,402 | 8/1981 | Sheets et al. | 431/9 |
| 4,525,141 | 6/1985 | DeWerth et al. | 431/347 |

FOREIGN PATENT DOCUMENTS

| | | | |
|---|---|---|---|
| 3117775 | 11/1982 | France | 431/350 |
| 1522879 | 4/1968 | Italy | 431/347 |

*Primary Examiner*—Margaret A. Focarino

*Attorney, Agent, or Firm*—Hill, Van Santen, Steadman & Simpson

[57] ABSTRACT

A metal insert is provided for reducing $NO_x$ emissions in a gas burner which comprises an inverted channel member having support legs movably retained in at least one of the burner ports to allow for movement caused by thermal expansion and contraction of the channel member. The channel member has downwardly extending leg portions positioned adjacent a high temperature zone of the gas flame and within a low temperature zone of the flame.

17 Claims, 10 Drawing Figures

FIG. 1
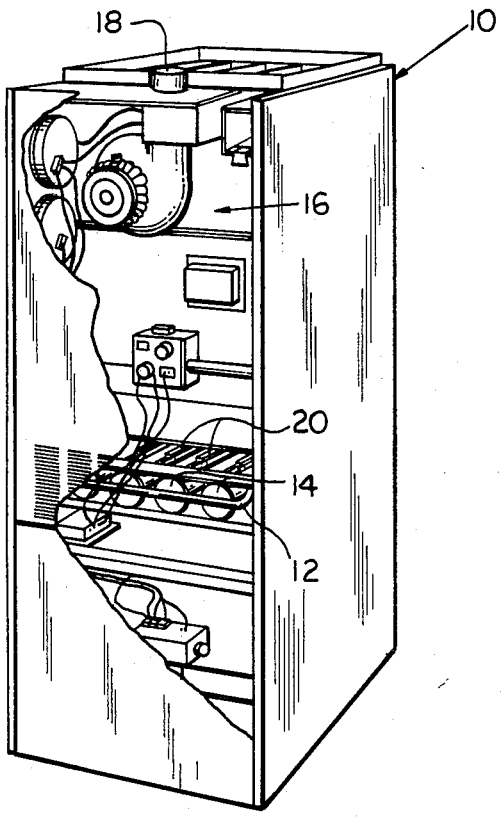
FIG 4
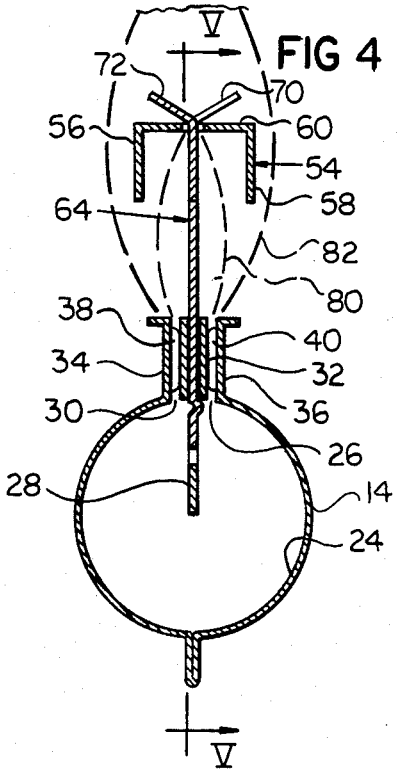
FIG 2
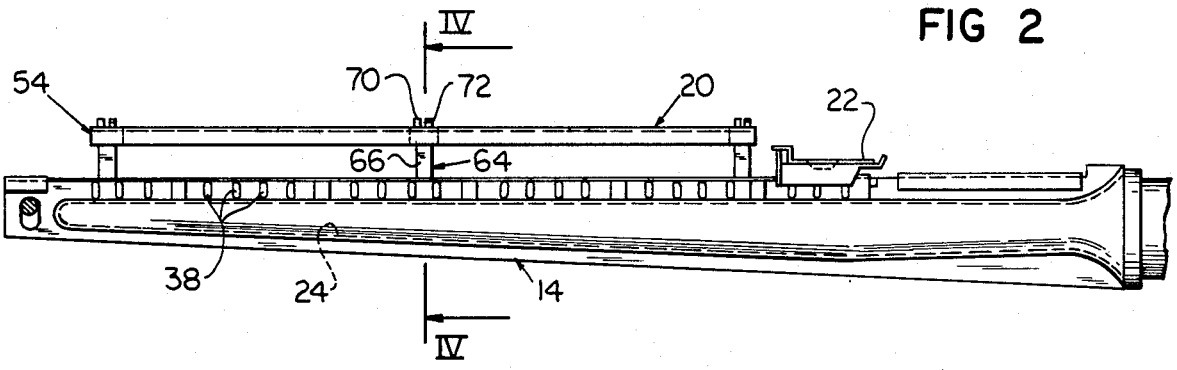
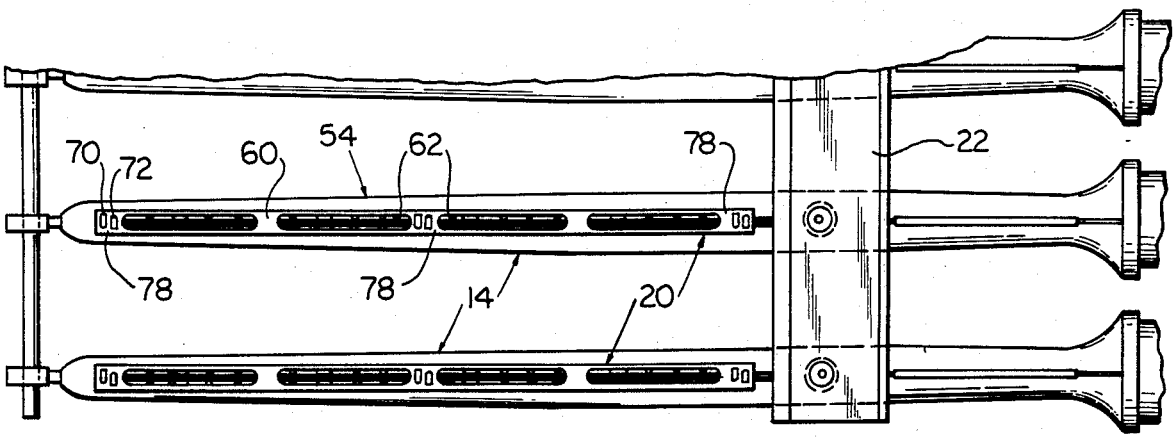
FIG 3

GAS BURNER WITH MEANS FOR REDUCING $NO_x$ EMISSIONS

BACKGROUND OF THE INVENTION

1. Field of the Invention

The invention relates to gas burners and more specifically to gas burners provided with means for reducing $NO_x$ emissions.

2. Description of the Prior Art

The combustion of natural gas in a residential gas furnace normally produces small quantities of various nitrous oxides, generally designated as $NO_x$ compounds. The compounds are undesirable pollutants, and their emission level is being increasingly subjected to regulation by various governmental entities. It has been known for some time that the level of $NO_x$ emission from a gas burner can be reduced by positioning a metallic insert within a certain region of the gas flame produced by the burner. A gas flame typically includes an inner cone having a very high temperature and an outer cone having a somewhat lower temperature. $NO_x$ emissions can be reduced by positioning a metallic insert immediately adjacent the inner cone of the flame. It appears that such inserts function to reduce the temperature of the inner cone, resulting in a decrease in $NO_x$ emissions.

U.S. Pat. No. 4,284,402 discloses the use of a plurality of vanes which are located within a particular region of the flame produced by an oil burner to reduce turbulence, for the purpose of reducing $NO_x$ emissions. This patent discloses, in FIG. 1 and associated text, that it is generally known that a conductive insert can be located adjacent to the inner cone of a flame to control the temperature of that portion of the flame for reducing $NO_x$ emissions.

There are also commercially available multi-port gas burners with $NO_x$ reduction inserts located within the same region of the flame. The inserts comprise steel rod members which are loosely coupled to upstanding supports which are welded to the sides of the burner.

SUMMARY OF THE INVENTION

The present invention provides a gas burner with means for reducing $NO_x$ emissions in which a slotted inverted channel shaped member positions an $NO_x$ reduction member on each side of the inner flame cone. Support means are used which extend downward into a burner port. To prevent deformation of the insert, there is provided a loose coupling between the support means and the burner in addition to a loose coupling between the support means and the insert. The present invention has several advantages over the prior art in that the insert can be installed on a conventional burner without modification of the burner. Also, installation of the insert does not require welding or any special fastening means. The insert is inexpensive and very easy to install on the production line. Additionally, since the insert does not tend to deform during use, the level of $NO_x$ reduction remains consistent.

BRIEF DESCRIPTION OF THE DRAWING

FIG. 1 is a perspective view of a gas furnace incorporating a plurality of gas burners embodying the principles of the present invention.

FIG. 2 is a side elevational view of a gas burner and $NO_x$ reduction insert.

FIG. 3 is a partial plan view of the burner and insert assembly shown in FIG. 2.

FIG. 4 is a sectional view taken generally along the lines IV—IV of FIG. 2.

DESCRIPTION OF THE PREFERRED EMBODIMENTS

Figure 5:
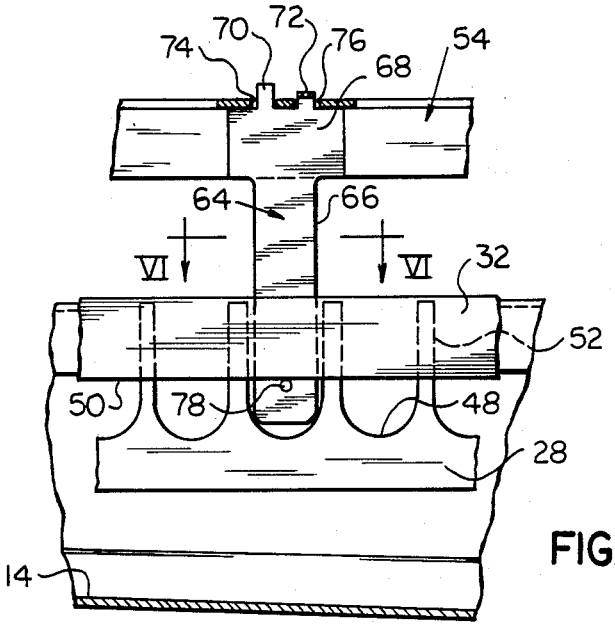
FIG. 5 is a partial side sectional view of the insert mounting arrangement within the burner

FIG. 1 shows in perspective a residential gas furnace generally at 10, including a gas supply line 12 feeding a plurality of gas burners 14, a heat exchanger unit 16 for transferring the heat energy from the gas burners 14 to air to be circulated within a heated zone and an exhaust vent 18 to be connected to appropriate conduits for directing combustion gases away from the furnace.

Since the combustion of natural gas normally produces small quantities of various nitrous oxides which are undesirable pollutants, the burners illustrated in FIG. 1 are provided with an insert 20 which reduces the level of nitrous oxide emissions. Such an insert is seen in greater detail in FIGS. 2–6.

In FIGS. 2, 3 and 4, there is seen a plurality of elongated burners 14 having positioned thereabove an insert 20 which is used to reduce the $NO_x$ emissions. The burners 14 are connected at one end by a cross-lighter 22 which insures that each of the burners is ignited from the pilot light or automatic ignition (not shown). The burner 14 has a hollow interior 24 with a longitudinal slot 26 providing communication between the hollow interior 24 and the exterior of the burner. Within the slot 26, three components comprising an inside or center flame spreader 28 (FIG. 5) and two outside flame spreaders 30, 32 are inserted.

The two outer flame spreader members 30, 32 have a relatively short height and the center flame spreader 28 has a relatively tall height as seen in FIGS. 4 and 5. The center flame spreader 28 has a series of round bottom notches 48 formed along its length which extend below a bottom edge 50 of the outer flame spreaders 30, 32 and individual fingers 52 extending upwardly therefrom. The fingers 52 are sandwiched between the two outer flame spreaders 30, 32. The bottom of the notch 48 is exposed to the interior 24 of the burner 14, thus providing a communication passage for gas from the interior of the burner 14 between the two outer flame spreaders 30, 32.

Figure 6:
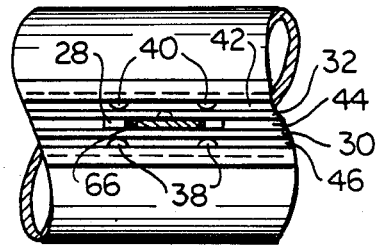
FIG. 6 is a sectional view of the mounting arrangement taken generally along the lines VI—VI of FIG. 5.
Figure 10:
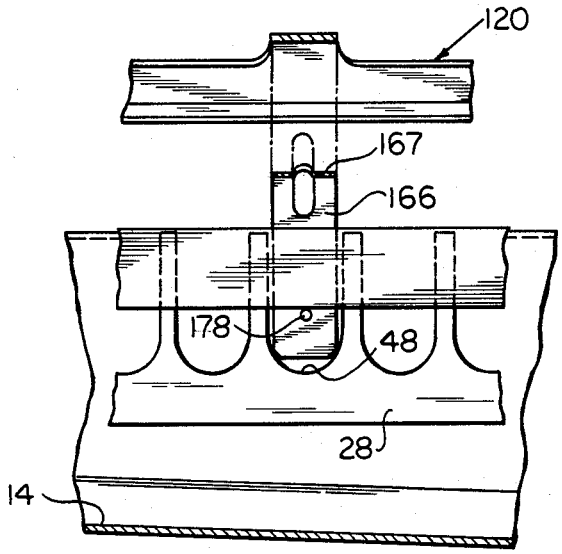
FIG. 10 is a partial side sectional view of the mounting arrangement of the alternate embodiment taken generally along lines X—X of FIG. 9.
Figure 9:
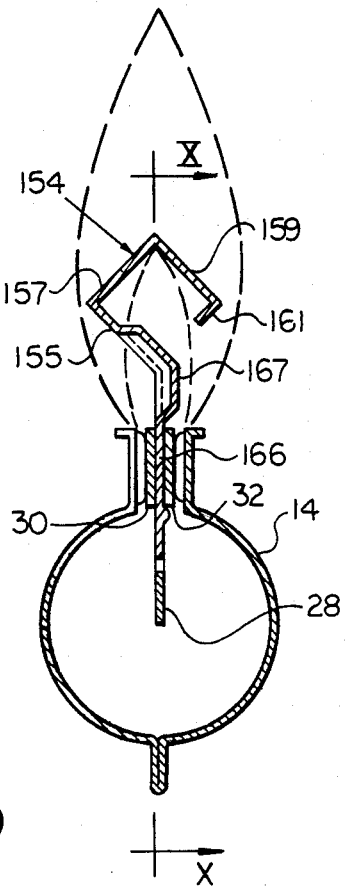
FIG. 9 is a sectional view of the alternate embodiment taken generally along the lines IX—IX of FIG. 7.
Figure 7:
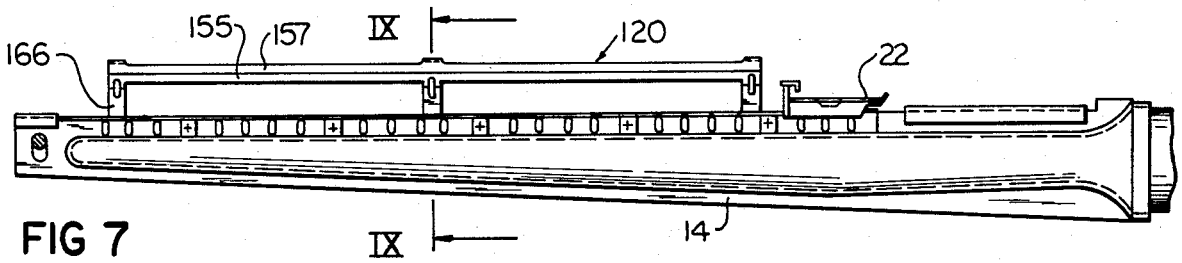
FIG. 7 is a side elevational view of an alternate embodiment of the insert.
Figure 8:
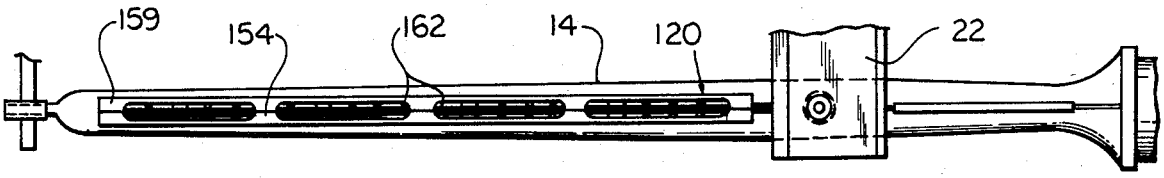
FIG. 8 is a plan view of the alternate embodiment shown in FIG. 7.

Referring to FIGS. 4 and 6, the burner 14 has a pair of opposed upstanding walls 34, 36 which form the slot 26. The walls 34, 36 are provided with a plurality of indentations or dimples 38, 40 which provide a space between the walls 34, 36 and the outer flame spreaders 30, 32, thereby providing a series of three side-by-side gas outlet ports 42, 44, 46 along the length of the burner 14.

As shown in FIGS. 2–5, each of the emission reduction inserts 20 is comprised of an elongated inverted channel member 54 which has a pair of leg portions 56, 58 extending perpendicularly from a connecting portion 60. The channel is then carried in an inverted U position such that the connecting portion 60 forms a top wall and the two leg portions form downwardly extending side walls. The connecting portion 60 is provided with a series of elongated slots 62 (FIG. 3) thereby removing most of the material from the connecting portion leaving land portions 78.

The channel members 54 are carried on support means such as legs 64 which comprise an elongated leg portion 66 having a width slightly less than the width of the notches 48 in the center flame spreader 28 (FIG. 5). At a top end of the leg portion 66, there is a T or shoulder portion 68 on which the channel member 54 rests. At the top of the shoulder portion 68 there are two upstanding tabs 70, 72, which are received loosely in openings 74, 76 in the land portions 78 between the slots 62 in the connecting portion 60 of the channel member 54. After the tabs 70, 72 have been inserted through the openings 74, 76, they are bent over in opposite directions to prevent separation of the channel member 54 from the support legs 64.

The bottom of the leg portion 66 is seated in the bottom of the notch 48 in the center flame spreader 28 as seen in FIG. 5. A protruding dimple 78 is spaced from the bottom of the leg portion such that it is positioned just below the bottom edge 50 of the outer flame spreader 30, 32. In this manner, the leg members 64 will be removably retained in the burner. Additionally, the provision of the dimple 78 provides a definite snap-fit "feel" as the support legs 64 are being inserted into the flame spreader assembly of the burner.

Since the width of the leg portion 66 is slightly less than that of the notch 48, a slight degree of pivotal movement of the leg portion 66 within the notch 48 is permitted, allowing some longitudinal adjustment of the insert. This longitudinal adjustment is desirable in that the channel member 54 is positioned within the gas flame (FIG. 4) such that the connecting portion 60 is slightly above the top of an inner high temperature cone 80 and the downwardly extending leg portions 56, 58 are positioned laterally adjacent the inner cone 80. An outer lower temperature cone 82 of the flame completely engulfs the entire channel assembly 20. Thus, the insert is subjected to high temperatures when the burner is on and relatively cool ambient temperatures when the burner is off, resulting in thermal expansion and contraction of the insert. Most of this expansion takes place in a longitudinal direction because of the elongated nature of the insert. Therefore, the loose connections between the channel member 54 and the leg members 64, as well as the loose, pivotable connection between the leg member 64 and the flame spreader assembly permit the expansion and contraction to take place.

The loose coupling, while allowing longitudinal expansion and contraction, also prevents lateral and vertical motion which are not desirable because such motion would tend to move the insert out of the desired position with respect to the inner flame cone. If the insert were a rigid member rigidly attached to the burner assembly, the thermal expansion and contraction could cause distortion of the insert resulting in vertical or lateral displacement.

An alternate embodiment of the invention is shown in FIGS. 7–10, wherein an insert member 120 of a slightly different configuration is provided. The insert 120 has an upper channel portion 154 supported above the burner 14 by a leg portion 166. The leg 166 is formed integrally with the channel portion 154 out of a single piece of material as opposed to being a separate piece as described in the embodiment shown in FIGS. 2–6. A strengthening rib 167 is stamped into the junction between the leg portion 166 and the channel portion 154 to insure vertical and lateral stability.

The leg portions 166 are fabricated substantially identically to the leg portion 66 shown in FIGS. 2–6 and are inserted and retained in the burner in an identical manner. As described above, the support leg portions 166 are slightly movable or pivotable within the central flame spreader 28 to allow for longitudinal expansion and contraction movement of the insert 120.

The channel portion 154 has a slightly different configuration than the channel portion 54 described above. In the alternate embodiment, the channel member 154 comprises four leg portions 155, 157, 159 and 161. Leg portion 155 is connected with the support leg 166 and is formed at an approximately 45° angle outwardly away from the inner flame cone 80. At an end opposite the end connecting with the support legs 166, the first channel leg 155 connects with the second channel leg 157 at an approximately 90° corner.

The second channel leg 157 extends at an approximately 45° angle toward the inner cone 80 and terminates at a point just above the tip of the inner cone where it connects with the third channel leg 159 at an approximately 90° angle. The third channel leg 159 extends downwardly approximately 45° away from the inner cone 80 and connects with the fourth channel leg 161 at an approximately 90° corner. The fourth channel leg 161 is relatively short and extends downwardly toward the inner flame cone at approximately 45°, but it terminates prior to the edge of the inner cone 80. The second and third channel legs 157, 159, thus form an inverted V-shaped top wall of the channel member 154 and they are provided with a series of elongated slots 162 along their junction as seen in the plan view of FIG. 8 to allow for the relatively unhindered passage of heat upward toward the heat exchanging unit.

The support leg portion 166 is again provided with a raised dimple 178 to give a snap-fit "feel" as the support leg is being inserted into the flame spreader assembly as described above.

Thus, the present invention provides for an $NO_x$ reduction insert in the form of a slotted, inverted channel shaped member to position the $NO_x$ reduction members, the side legs of the channel members, on each side of the inner flame cone. Support means, comprising support legs, are provided which extend downward into a burner port allowing installation of the insert without welding or any special fastening means and allowing installation on a conventional burner without modification of the burner. Also, the insert can be fabricated inexpensively and is very easy to install on the production line. The present invention provides a loose coupling between the support means and the burner (in addition to a loose coupling between the support means and the insert), which prevents deformation of the insert. Since deformation is avoided, the level of $NO_x$ reduction remains consistent.

As is apparent from the foregoing specification, the invention is susceptible of being embodied with various alterations and modifications which may differ, particularly from those that have been described in the preceeding specification and description. It should be understood that I wish to embody within the scope of the patent warranted hereon all such modifications as reasonably and properly come within the scope of my contribution to the art.

I claim as my invention:

1. In a gas burner having a plurality of serially arranged burner ports for producing a gas flame which extends along at least a portion of the length of the burner, said flame having an inner, high temperature region and an outer region of lower temperature, means for reducing $NO_x$ emissions during operation of said burner comprising:

a metal insert extending along and proximate to at least a portion of said serially arranged burner ports, said insert disposed within said lower temperature region of said gas flame directly adjacent said higher temperature region of said flame; and support means extending from said insert into at least one of said burner ports, said support means being slightly smaller in cross section than said burner port so as to be movably retained within said burner port to permit slight longitudinal movement of said insert in response to thermal expansion and contraction of said insert relative to said burner as an incident of operation of said burner.

2. The device of claim 1 wherein said metal insert comprises wall means forming a slotted, inverted channel member having downwardly extending leg portions adjacent said higher temperature region of said flame.

3. The device of claim 2 wherein said slots are formed in a portion of said channel connecting said downwardly extending leg portions.

4. The device of claim 2 wherein said channel member has a U-shaped configuration.

5. The device of claim 2 wherein said channel member has a V-shaped configuration.

6. The device of claim 1 wherein said support means comprise a plurality of leg members movably retained by said metal insert as well as by said burner port.

7. The device of claim 6 wherein said leg members have a top shoulder portion for supporting said metal insert and protruding tabs loosely engageable with said insert to movably retain said legs with respect to said insert.

8. The device of claim 2 wherein said support means comprise leg portions formed integrally with said channel member.

9. In a gas burner having a plurality of serially arranged burner ports for producing a gas flame which extends along at least a portion of the length of the burner, said flame having an inner, high temperature region and an outer region of lower temperature, means for reducing $NO_x$ emissions during operation of said burner comprising:

a metal insert comprising means forming an inverted channel member having slots and extending along and proximate to at least a portion of said serially arranged burner ports, said channel member having downwardly extending the leg portions disposed within said lower temperature region of said gas flame directly adjacent said higher temperature region of said flame; and support means extending from said channel member into at least one of said burner ports and being slightly smaller in cross section than said burner port so as to be movably retained with respect to said burner to permit slight longitudinal movement of said channel member in response to thermal expansion and contraction of said channel member relative to said burner as an incident of operation of said burner.

10. The device of claim 9 wherein said slots are formed in a portion of said channel member connecting said downwardly extending leg portions.

11. The device of claim 9 wherein said channel member has a U-shaped configuration.

12. The device of claim 9 wherein said channel member has a V-shaped configuration.

13. The device of claim 9 wherein said support means extends into at least one of said burner ports and is movably retained within said burner port.

14. The device of claim 9 wherein said support means comprise a plurality of leg members movably retained by said channel member.

15. The device of claim 14 wherein said leg members have a top shoulder portion for supporting said metal insert and protruding tabs loosely engageable with said channel member to movably retain said legs with respect to said channel member.

16. The device of claim 9 wherein said support means comprise leg portions formed integrally with said channel member.

17. In a gas burner having a plurality of serially arranged burner ports for producing a gas flame which extends along at least a portion of the length of the burner, said flame having an inner, high temperature region and an outer region of lower temperature, means for reducing $NO_x$ emissions during operation of said burner comprising:

an elongated metal insert having a U-shaped channel member comprised of two opposed wall portions and a connecting wall portion, at least one supporting member loosely attached at one end to said channel member and longitudinally loosely attached at an opposite end in one of said burner ports, said supporting member having a downwardly extending leg portion engageable in said burner port and an upper end including a shoulder portion to support said channel member, said shoulder portion having a pair of upstanding tabs engageable with holes in said channel member to loosely retain said supporting member and said channel member in assembled relationship, said channel member carried in an inverted position with said opposed wall portions depending downwardly from said connecting wall portion, said opposed wall portions positioned within said lower temperature region of said gas flame directly adjacent said higher temperature region of said flame, and said connecting portion forming a series of slots to allow passage of heat through said channel portion, whereby slight longitudinal movement of said channel portion in reponse to thermal expansion and contraction is permitted due to said loose attachments while lateral and vertical stability is retained.

* * * * *